US012680429B2

(12) United States Patent
Skeete

(10) Patent No.: US 12,680,429 B2
(45) Date of Patent: Jul. 14, 2026

(54) TAIL PLUG AND ASSEMBLY FOR GAS LIFT VALVE

(71) Applicant: Tally Production Systems, LLC, Houston, TX (US)

(72) Inventor: Aaron Michael Benjamin Skeete, Katy, TX (US)

(73) Assignee: TALLY PRODUCTION SYSTEMS, LLC, Houston, TX (US)

( * ) Notice: Subject to any disclaimer, the term of this patent is extended or adjusted under 35 U.S.C. 154(b) by 34 days.

(21) Appl. No.: 18/925,487

(22) Filed: Oct. 24, 2024

(65) Prior Publication Data

US 2025/0137363 A1 May 1, 2025

Related U.S. Application Data

(60) Provisional application No. 63/594,736, filed on Oct. 31, 2023.

(51) Int. Cl.
*E21B 43/12* (2006.01)

(52) U.S. Cl.
CPC ..... *E21B 43/123* (2013.01); *Y10T 137/2934* (2015.04)

(58) Field of Classification Search
CPC ..... E21B 43/123; Y10T 137/2934
See application file for complete search history.

(56) References Cited

U.S. PATENT DOCUMENTS

| | | | | | |
|---|---|---|---|---|---|
| 3,646,953 | A * | 3/1972 | Elliott | E21B 43/123 | 417/115 |
| 3,722,527 | A * | 3/1973 | Blackwell | E21B 43/123 | 137/155 |
| 3,807,428 | A * | 4/1974 | Watkins | E21B 43/123 | 137/71 |
| 4,111,608 | A * | 9/1978 | Elliott | E21B 43/122 | 417/115 |
| 4,441,519 | A * | 4/1984 | Terral | E21B 43/123 | 417/112 |
| 4,520,601 | A * | 6/1985 | Stacey, Jr. | F16B 37/043 | 411/103 |
| 4,562,854 | A * | 1/1986 | Pringle | E21B 34/06 | 137/155 |
| 5,421,241 | A * | 6/1995 | Terral | E21B 43/121 | 92/42 |
| 12,012,830 | B1 * | 6/2024 | Burrows | E21B 43/123 | |
| 2007/0227739 | A1 * | 10/2007 | Becker | E21B 43/123 | 166/321 |
| 2013/0220599 | A1 * | 8/2013 | Rae | E21B 34/105 | 166/250.01 |
| 2016/0290099 | A1 * | 10/2016 | Balasubramanian | E21B 43/123 | |
| 2021/0054725 | A1 * | 2/2021 | Salihbegovic | E21B 43/123 | |

(Continued)

*Primary Examiner* — Robert K Arundale
(74) *Attorney, Agent, or Firm* — Michael Dowler; Park, Vaughan, Fleming & Dowler LLP

(57) ABSTRACT

Embodiments of the present invention relate to an improved tail plug and assembly for a gas lift valve for use in oil and gas wells. The tail plug assists in preventing a pressurized component of the gas lift valve from depressurizing through leaks in the valve to the ambient. At least portion of the tail plug may be formed from brass and other portions of the gas lift valve may be formed from stainless steel. The tail plug may be maintained in the gas lift valve via an NPT treaded connection. The tail plug may further prevent leaks via an O-ring and/or a crush washer.

48 Claims, 3 Drawing Sheets

(56) References Cited

U.S. PATENT DOCUMENTS

| | | | | |
|---|---|---|---|---|
| 2021/0340848 | A1* | 11/2021 | Salihbegovic | E21B 43/123 |
| 2024/0247572 | A1* | 7/2024 | Bigelow | E21B 34/066 |
| 2024/0271510 | A1* | 8/2024 | Murski | E21B 43/123 |

* cited by examiner

TAIL PLUG AND ASSEMBLY FOR GAS LIFT VALVE

PRIORITY CLAIM

This application claims priority to provisional patent application Ser. No. 63/594,736 filed Oct. 31, 2023, which is fully incorporated herein by reference.

BACKGROUND

Technical Field

Embodiments of the subject matter disclosed herein relate to an improved tail plug and assembly for a gas lift valve for use in oil and gas wells.

Discussion of the Background

Those skilled in the art know that gas lift mandrels and valves play a crucial role in enhancing oil and gas production from wells, particularly in challenging conditions where traditional methods may fall short. These systems utilize the injection of gas to lighten the hydrostatic column of fluid in the wellbore, thereby reducing the pressure required to lift fluids to the surface. This method is especially beneficial in wells with low reservoir pressure or high fluid viscosity, where conventional pumping techniques may struggle.

At the core of gas lift systems are mandrels, which are tubular devices installed at various depths in the well. These mandrels serve as anchor points for the gas lift valves, which control the injection of gas into the produced fluids. The design of the mandrel allows for easy installation and retrieval of the valves, facilitating maintenance and adjustments without needing to pull the entire tubing string. This flexibility is a significant advantage in maximizing production efficiency and minimizing downtime.

The gas lift valves are strategically positioned within the mandrels to regulate gas flow based on the relative pressure between lift gas injected into the well and pressure and fluid levels in the well itself. When the reservoir pressure drops or when fluid levels are insufficient for natural flow, the valves can open to allow gas to enter the wellbore. This injection reduces the density of the fluid column, enabling the hydrostatic pressure to be overcome more easily. As a result, the mixture of gas and fluid can be lifted to the surface with less energy.

A key benefit of using gas lift systems is their adaptability. Operators can adjust the amount and timing of gas injection based on real-time data from the well. This ability to dynamically control production allows for optimization based on varying reservoir conditions, which can significantly improve recovery rates. In essence, gas lift systems can be tailored to fit the specific characteristics of a well, leading to enhanced production efficiency.

Another advantage of gas lift technology is its lower operational costs compared to other artificial lift methods. Unlike electric submersible pumps (ESPs) or rod pumps, gas lift systems do not require extensive electrical infrastructure or complex mechanical components. This simplicity translates to reduced maintenance costs and fewer failures, making gas lift an attractive option for operators seeking to minimize expenses while maximizing output.

Moreover, gas lift systems can be deployed in environments where other artificial lift methods may be impractical. For instance, in offshore applications or remote locations with limited access to power sources, gas lift provides a reliable alternative that can be implemented with minimal logistical challenges. This versatility enables operators to extend the productive life of their wells and make the most of available resources.

As the oil and gas industry continues to evolve, the integration of advanced monitoring and control technologies with gas lift systems offers evolving possibilities. By incorporating sensors and real-time data analytics, operators can achieve even greater precision in managing gas injection and production rates. This integration can lead to improved recovery factors and more efficient use of reservoir resources, ultimately enhancing the economic viability of oil and gas projects.

Heretofore, however, gas lift valves have suffered leaks that diminish the efficiency and operability of the valves themselves. As those skilled in the art know, the ability of a gas lift valve to maintain a predetermined (or set) pressure level is important to the efficient operation of the valve in a well. Indeed, beyond mere inefficiencies, valve failures can result in costly delays and equipment costs if the valve(s) must be replaced.

FIG. 1 illustrates a cross-section of an exemplary, prior art gas lift valve 10. As those skilled in the art will appreciate, such valves include (among other components) gas chamber 15, gas injection valve core 20, tail plug 25, and dome cap 45. The gas lift valve is "charged" to a predetermined pressure level by injecting a gas into gas chamber 15 via gas injection valve core 20, i.e., when tail plug 25 is removed from dome cap 45, thereby providing a gas charging system access to gas injection valve core 20.

As indicated, although it is desirable and important that gas chamber 15 remain charged to its predetermined pressure level, such prior art gas lift valves can suffer from leakage of gas/pressure from chamber 15, principally on a path past gas injection valve core 20 and tail plug 25 and on to the ambient outside gas lift valve 10. This gas/pressure leakage can occur despite efforts to design gas injection valve core 20 and tail plug 25 to prevent such leakage. Reasons for the leakage can vary, including operators not properly torquing tail plug 25 in place.

As shown in more detail in FIG. 1 and in FIG. 2 (which is an enlarged version of detail A in FIG. 1), the prior art gas lift valve 10 includes gas injection valve core 20 mounted in a bore of dome cap 45. Since these valve cores are known to be a potential source of leakage from gas chamber 15, tail plug 25 is used to further prevent such leakage. As shown and described for the prior art device shown in FIGS. 1 and 2, stainless-steel tail plug 25 is inserted into stainless-steel dome cap 45 using a straight thread. This further serves to inhibit leakage from gas chamber 15 to the ambient. To prevent leakage of gas even further (across the interface between tail plug 25 and dome cap 45), O-ring seal 30 and copper crush washer 35 are deployed as shown in FIG. 2. As those skilled in the art appreciate, the O-ring serves to create an airtight boundary across which it is difficult for gases/liquids to travel, whereas the copper crush washer seeks to serve the same purpose by its deformations filling leak spots/paths when the tail plug is installed and tightened into place to a degree that the washer crushes between the plug and dome cap. Despite these efforts, it has been observed that gas/pressure still can leak from gas chamber 15 through and/or around gas injection valve core 20 and across the interface between dome cap 45 and tail plug 25 to the ambient outside the gas lift valve. Again, reasons for these leaks can vary, including the failure of operators to properly torque gas lift valve 10 into dome cap 45. Whatever the reason, applicant has discovered a new and improved tail plug and assembly for gas lift valves that better prevents the heretofore described leaks in such valves.

FIG. 3 is a perspective view of tail plug 25 (from FIGS. 1 and 2), including O-ring seal groove 31 for housing O-ring 30, copper crush washer groove 36 for housing copper crush washer 35, and the male portion of straight thread 40 that interfaces with the female portion of such straight thread on dome cap 45 (best shown in FIG. 2).

BRIEF DESCRIPTION OF THE DRAWINGS

The following disclosure may be understood by reference to the description herein taken in conjunction with the accompanying drawings, in which like reference numerals identify like elements. The accompanying drawings, which are incorporated herein and constitute a part of the specification, illustrate one or more exemplary embodiments of the present invention, except where the drawings are indicated to illustrate the prior art. The present invention should not be considered limited to the following drawings. In the drawings.

DETAILED DESCRIPTION

Various features and advantageous details are explained more fully with reference to the non-limiting embodiments that are illustrated in the accompanying drawings and detailed in the description herein. Descriptions of well-known starting materials, processing techniques, components, and equipment are omitted so as not to unnecessarily obscure the invention. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended or implied. To the extent that a term or phrase is intended to have a special meaning, i.e., a meaning other than that understood by skilled artisans, such special definition will be expressly set forth in the specification in a definitional manner that directly and unequivocally provides the special definition for the term or phrase.

Figure 1:
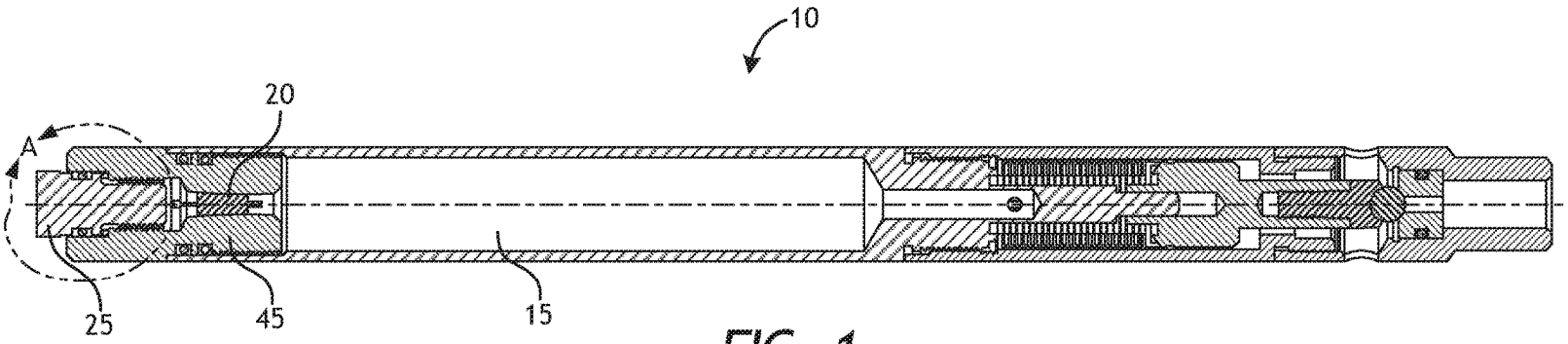
FIG. 1 (PRIOR ART)
FIG. 1 is a cross-section of an exemplary, prior art gas lift valve.
Figure 2:
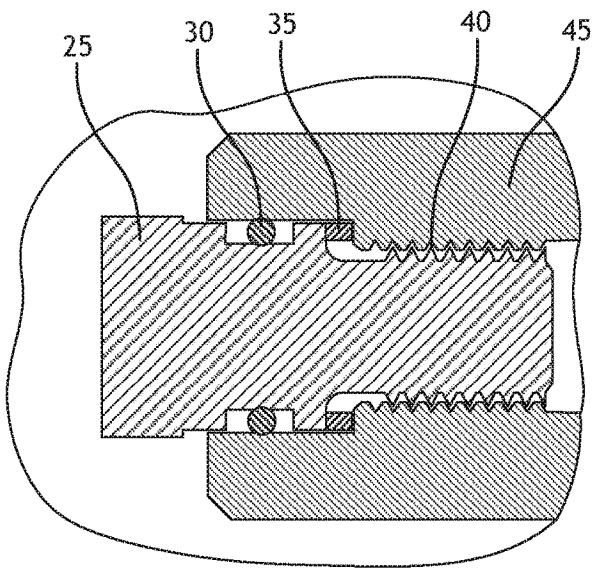
FIG. 2 (PRIOR ART)
FIG. 2 is an enlarged version of detail A in FIG. 1.
Figure 3:
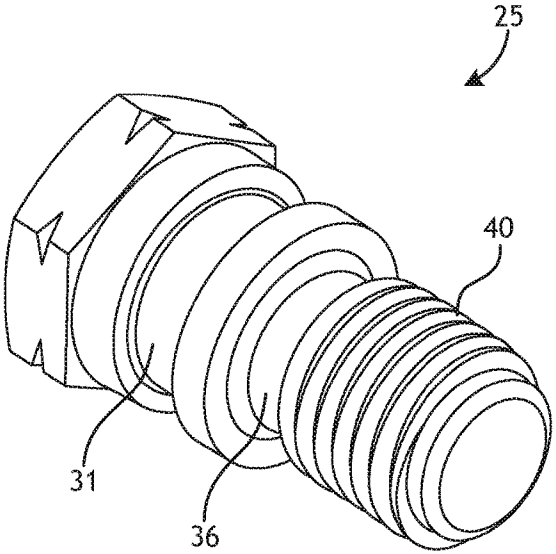
FIG. 3 (PRIOR ART)
FIG. 3 is a perspective view of the tail plug shown in FIG. 1 and FIG. 2.
Figure 4:
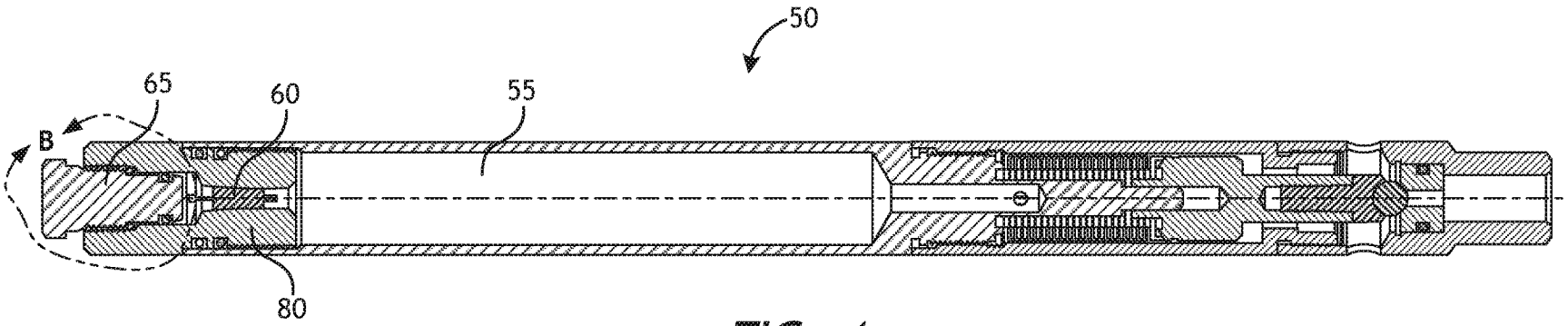
FIG. 4 is a cross-section of an exemplary gas lift valve of one embodiment of the present invention.

The present exemplary embodiments describe an improved tail plug and assembly for a gas lift valve. Those skilled in the art will appreciate that other embodiments are contemplated. For example, FIG. 4 illustrates a cross-section of an exemplary embodiment of gas lift valve 50 including an embodiment of the present invention. As shown, valve 50 may include (among other components/portions) gas chamber 55, gas injection valve core 60, tail plug 65, and dome cap 80. In this embodiment, of which there are others within the scope of the present invention, gas lift valve 50 includes a bore for receiving dome cap 80. Dome cap 80 is maintained in the bore of gas lift valve 50 via a threaded connection, but those skilled in the art will appreciate that it can be maintained therein by other means, including a weld, pin, or other means. Likewise, dome cap 80 need not be a separate/detachable component from the body of gas lift valve 50.

In the embodiment of FIG. 4, dome cap 80 likewise has a bore that communicates with gas chamber 55 and the ambient outside gas lift valve 50. As also shown, gas injection valve core 60 can be mounted in the bore of dome cap 80 via a threaded connection or other connections known in the art. As with the prior art gas lift valves, gas lift valve 50 is "charged" to a predetermined pressure level by injecting a gas into gas chamber 55 via gas injection valve core 60.

Figure 5:
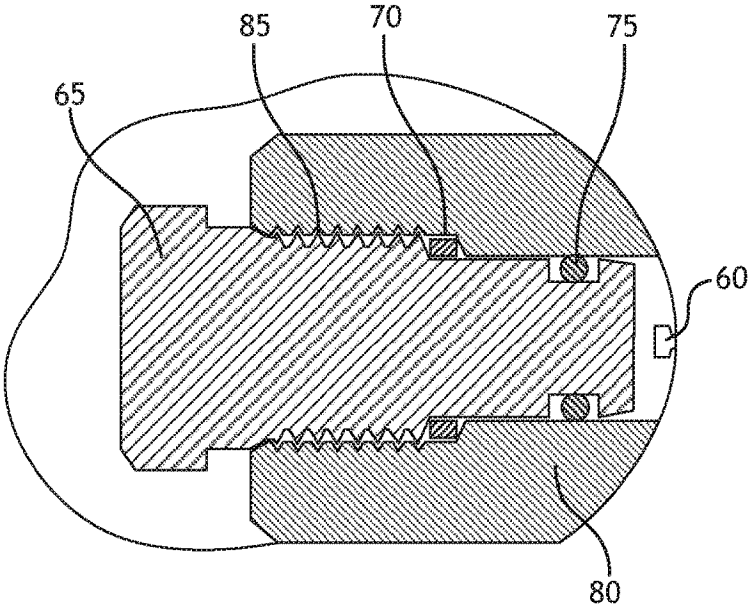
FIG. 5 is an enlarged version of detail B in FIG. 4.

As shown in more detail in FIG. 5 (which is an enlarged version of detail B in FIG. 4) brass tail plug 65 is inserted into stainless-steel dome cap 80 using NPT thread 85, as opposed to straight thread 40 referenced above in connection with the prior art. As those skilled in the art appreciate, a straight thread has a uniform diameter along its length, meaning it remains the same size from one end to the other, typically used for non-tapered applications. In contrast, an NPT (National Pipe Tapered) thread features a tapered design, which means the diameter gradually decreases along the length of the thread. This tapering allows for a tighter seal when connecting pipes, making NPT threads ideal for plumbing and fluid transfer applications, where preventing leaks is essential.

Applicant has discovered (among other things disclosed here and as will be appreciated by those skilled in the art by reading the present application) that using an NPT thread to connect a brass tail plug to a stainless-steel dome cap creates a better barrier against leaks of the type described above in the prior art. Aside from the enhanced leak-proof barrier provided by the NPT thread itself, this enhanced barrier appears to be particularly efficient at eliminating leaks in embodiments where the brass tail plug includes male threads and the stainless-steel dome cap includes female threads since the softer brass tail plug's male threads crush and deform into the dome cap's harder stainless-steel female threads. Applicant has discovered that the leak-proof nature of this design is not as susceptible to operators not properly torquing the tail plug into the dome cap as was the case in the prior art.

In still other/alternate embodiments, the leak path may be further enhanced against leaks by including copper crush washer 70 and/or O-ring seal 75 in the path as shown in the exemplary embodiment of FIG. 5. Notably, in one embodiment, the order of copper crush washer 70 and O-ring seal 75 as arranged on tail plug 65 is reversed with respect to that of the prior art, which applicant also has discovered enhances the leak-proof nature of the tail plug. In other words, in this embodiment (as opposed to the prior art embodiments) the copper crush washer is placed closer to the top/ambient end of the dome cap than the O-ring.

Figure 6:
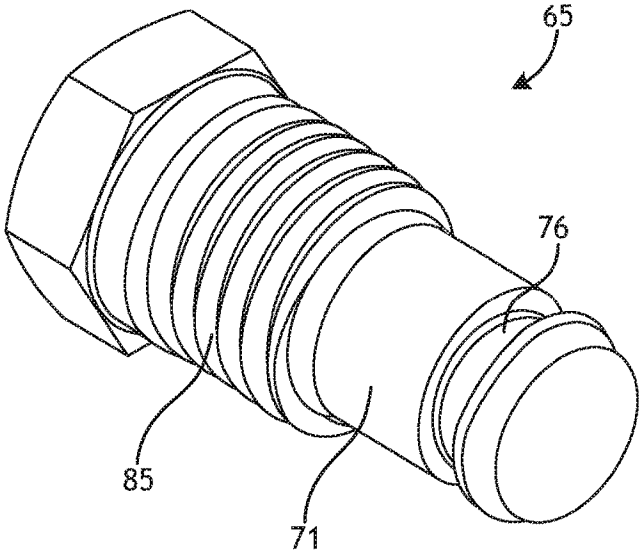
FIG. 6 is a perspective view of the tail plug shown in FIG. 4 and FIG. 5.

FIG. 6 is a perspective view of tail plug 65 (from FIGS. 4 and 5), including O-ring seal groove 76 for housing O-ring 75, copper crush washer groove 71 for housing copper crush washer 70, and the male portion of NPT thread 85 that interfaces with the female portion of such NPT thread on dome cap 80 (best shown in FIG. 5). For embodiments not including copper crush washer 70 and/or O-ring seal 75, FIG. 6 could be modified to not include regions for housing those components.

Figure 7:
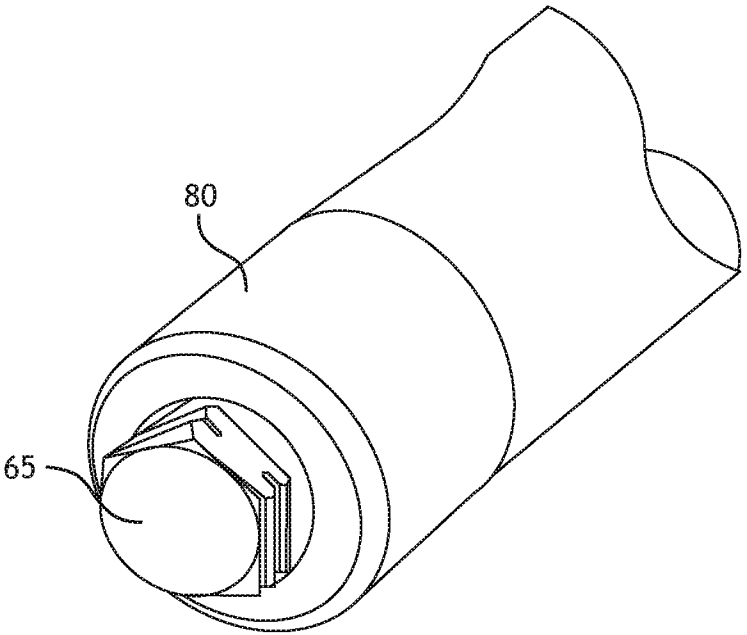
FIG. 7 is a perspective view of an end of an exemplary gas lift valve showing a tail plug inserted into the dome cap of a gas lift valve.

Finally, FIG. 7 is a perspective view of an end of an exemplary gas lift valve showing a tail plug 65 inserted into dome cap 80 of the gas lift valve.

Although the invention(s) is/are described herein with reference to specific embodiments, various modifications and changes can be made without departing from the scope of the present invention(s), as set forth in the claims below. Accordingly, the specification and Figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

Accordingly, the protection sought herein is as set forth in the claims below.

The invention claimed is:

1. A gas lift valve, comprising:

a gas chamber inside the gas lift valve;

a dome cap at least partially formed from stainless steel having a bore there-through, where the bore includes a first end in fluid communication with the gas chamber and a second end in fluid communication with an ambient atmosphere outside the gas lift valve; and a tail plug at least partially formed from brass for sealing at least a portion of the bore of the dome cap, wherein the tail plug incudes a first region including an O-ring seal and a second region, separated from the first region, including a crush washer, where the first region is closer to the first end of the bore of the dome cap than the second region.

2. The gas lift valve of claim 1 wherein the tail plug seals at least a portion of the bore of the dome cap to substantially prevent a gas in the gas chamber from leaking through the dome cap to the ambient atmosphere outside the gas lift valve.

3. The gas lift valve of claim 2 wherein the tail plug seals the bore of the dome cap via a threaded connection.

4. The gas lift valve of claim 3 wherein the threaded connection is an NPT connection.

5. The gas lift valve of claim 4 wherein the threaded connection is a brass to stainless steel connection.

6. The gas lift valve of claim 5 wherein the O-ring seal is disposed around the tail plug to further seal at least a portion of the bore of the dome cap.

7. The gas lift valve of claim 6 wherein the crush washer is disposed around the tail plug to further seal at least a portion of the bore of the dome cap.

8. The gas lift valve of claim 7 wherein the crush washer is disposed around the tail plug closer to the second end of the bore of the dome cap than the O-ring seal.

9. The gas lift valve of claim 8 further comprising a gas injection valve core disposed in the bore of the dome cap between the first end of the bore and the second end of the bore.

10. The gas lift valve of claim 9 wherein the gas injection valve core is disposed in the bore of the dome cap closer to the first end of the bore of the dome cap than the tail plug.

11. The gas lift valve of claim 10 wherein the dome cap is detachable from the gas lift valve.

12. The gas lift valve of claim 11 wherein the crush washer is made from copper.

13. A gas lift valve, comprising:

a gas chamber;

a bore at least partially formed from stainless steel having a first end in fluid communication with the gas chamber and a second end in fluid communication with an ambient atmosphere; and a tail plug at least partially formed from brass for sealing at least a portion of the bore, wherein the tail plug incudes a first region including an O-ring seal and a second region, separated from the first region, including a crush washer, where the first region is closer to the first end of the bore of the dome cap than the second region.

14. The gas lift valve of claim 13 wherein the tail plug seals at least a portion of the bore to substantially prevent a gas in the gas chamber from leaking through the bore to the ambient atmosphere.

15. The gas lift valve of claim 14 wherein the tail plug seals the bore via a threaded connection.

16. The gas lift valve of claim 15 wherein the threaded connection is an NPT connection.

17. The gas lift valve of claim 16 wherein the threaded connection is a brass to stainless steel connection.

18. The gas lift valve of claim 17 wherein the O-ring seal is disposed around the tail plug to further seal at least a portion of the bore.

19. The gas lift valve of claim 18 wherein the crush washer is disposed around the tail plug to further seal at least a portion of the bore.

20. The gas lift valve of claim 19 wherein the crush washer is disposed around the tail plug closer to the second end of the bore than the O-ring seal.

21. The gas lift valve of claim 20 further comprising a gas injection valve core disposed in the bore between the first end of the bore and the second end of the bore.

22. The gas lift valve of claim 21 wherein the gas injection valve core is disposed in the bore closer to the first end of the bore than the tail plug.

23. The gas lift valve of claim 22 wherein the crush washer is made from copper.

24. A gas lift valve, comprising:

a gas chamber inside the gas lift valve;

a dome cap having a bore there-through, where the bore includes a first end in fluid communication with the gas chamber and a second end in fluid communication with an ambient atmosphere outside the gas lift valve; and a tail plug for sealing at least a portion of the bore of the dome cap, wherein the tail plug incudes a first region including an O-ring seal and a second region, separated from the first region, including a crush washer, where the first region is closer to the first end of the bore of the dome cap than the second region.

25. The gas lift valve of claim 24 wherein the tail plug seals at least a portion of the bore of the dome cap to substantially prevent a gas in the gas chamber from leaking through the dome cap to the ambient atmosphere outside the gas lift valve.

26. The gas lift valve of claim 25 wherein the tail plug seals the bore of the dome cap via a threaded connection.

27. The gas lift valve of claim 26 wherein the threaded connection is an NPT connection.

28. The gas lift valve of claim 27 wherein the threaded connection is a brass to stainless steel connection.

29. The gas lift valve of claim 28 wherein the O-ring seal is disposed around the tail plug to further seal at least a portion of the bore of the dome cap.

30. The gas lift valve of claim 29 wherein the crush washer is disposed around the tail plug to further seal at least a portion of the bore of the dome cap.

31. The gas lift valve of claim 30 wherein the crush washer is disposed around the tail plug closer to the second end of the bore of the dome cap than the O-ring seal.

32. The gas lift valve of claim 31 further comprising a gas injection valve core disposed in the bore of the dome cap between the first end of the bore and the second end of the bore.

33. The gas lift valve of claim 32 wherein the gas injection valve core is disposed in the bore of the dome cap closer to the first end of the bore of the dome cap than the tail plug.

34. The gas lift valve of claim 33 wherein the dome cap is detachable from the gas lift valve.

35. The gas lift valve of claim 34 wherein the crush washer is made from copper.

36. The gas lift valve of claim 35 wherein the tail plug is at least partially formed from brass.

37. A gas lift valve, comprising:

a gas chamber;

a bore having a first end in fluid communication with the gas chamber and a second end in fluid communication with an ambient atmosphere; and a tail plug for sealing at least a portion of the bore, wherein the tail plug incudes a first region including an O-ring seal and a second region, separated from the first region, including a crush washer, where the first region is closer to the first end of the bore of the dome cap than the second region.

38. The gas lift valve of claim 37 wherein the tail plug seals at least a portion of the bore to substantially prevent a gas in the gas chamber from leaking through the bore to the ambient atmosphere.

39. The gas lift valve of claim 38 wherein the tail plug seals the bore via a threaded connection.

40. The gas lift valve of claim 39 wherein the threaded connection is an NPT connection.

41. The gas lift valve of claim 40 wherein the threaded connection is a brass to stainless steel connection.

42. The gas lift valve of claim 41 wherein the O-ring seal is disposed around the tail plug to further seal at least a portion of the bore.

43. The gas lift valve of claim 42 wherein the crush washer is disposed around the tail plug to further seal at least a portion of the bore.

44. The gas lift valve of claim 43 wherein the crush washer is disposed around the tail plug closer to the second end of the bore than the O-ring seal.

45. The gas lift valve of claim 44 further comprising a gas injection valve core disposed in the bore between the first end of the bore and the second end of the bore.

46. The gas lift valve of claim 45 wherein the gas injection valve core is disposed in the bore closer to the first end of the bore than the tail plug.

47. The gas lift valve of claim 46 wherein the crush washer is made from copper.

48. The gas lift valve of claim 47 wherein the tail plug is at least partially formed from brass.

* * * * *